United States Patent [19]

Stoppazzini

[11] Patent Number: 4,873,845

[45] Date of Patent: Oct. 17, 1989

[54] DEVICE FOR SUPPORTING THE THREAD GUIDE OF AN AUTOMATIC FLAT KNITTING MACHINE

[75] Inventor: Benito Stoppazzini, Sala Bolognese, Italy

[73] Assignee: E.M.M. Emiliana Macchine Maglieria S.r.l., Padulle di Sala Bolognese, Italy

[21] Appl. No.: 314,974

[22] Filed: Feb. 24, 1989

[30] Foreign Application Priority Data

Mar. 1, 1988 [IT] Italy ..... 4750/88

[51] Int. Cl.[4] ..... D04B 15/52

[52] U.S. Cl. ..... 66/126 R; 66/127

[58] Field of Search ..... 66/126 R, 127, 128, 66/130

[56] References Cited

U.S. PATENT DOCUMENTS

| | | | |
|---|---|---|---|
| 3,237,432 | 3/1966 | Jette | 66/126 R |
| 4,052,865 | 10/1977 | Zamarco | 66/127 |
| 4,738,124 | 4/1988 | Stoll et al. | 66/127 |

*Primary Examiner*—Ronald Feldbaum

*Attorney, Agent, or Firm*—Stevens, Davis, Miller & Mosher

[57] ABSTRACT

The device is fitted to a flat knitting machine that comprises a carriage moving in a horizontal plane above two needle beds and featuring anchor plates that are able to move in a vertical plane.

The device comprises a series of slides coupled with a bar, located above the needle beds, and provided with thread guides, each slide featuring a track in which two facing ledges are formed that can be struck by one of the anchor plates, consequently causing the slide to be drawn along. Two rockers pivot upon the slide, each of the these comprising two arms first and second, which respectively work in conjunction with a related ledge and a related side of the slide.

If the second arm is kept alongside the side, the anchor plate is prevented from striking against the ledge whilst when the same second arm is moved away from the side the anchor plate strikes against the ledge.

3 Claims, 8 Drawing Sheets

M
S
T
P3
R
2
3
40
41
41a
42
43
44
50a
50b
50c
90
100a
100b
100c
100d
101a
101b
101c

DEVICE FOR SUPPORTING THE THREAD GUIDE OF AN AUTOMATIC FLAT KNITTING MACHINE

BACKGROUND OF THE INVENTION

The present invention concerns the technical sector covering knitting machines and is particularly referred to a device for supporting the thread guide of these machines.

DESCRIPTION OF THE PRIOR ART

Known knitting machines comprise two needle beds, located symmetrically to one another, above which a carriage moves, during its movement causing the needles in the needle beds to be selected following a preset program, also feeding out the thread coming from the various different bobbins to the set of needles.

These knitting machine feature bars for this latter operation which are located above the needle beds, parallel to one another and to the said needle beds, and slides, which are able to move along these bars, and feature the same number of thread guides, with functions known to experts in the sector.

The above-mentioned carriage features vertically movable anchor plates that are able to strike the selected slides and move them along together with the carriage itself.

The stroke of the slides is limited by stops which can be locked in position on the same bars, these stops being shaped so as to enable the above-mentioned anchor plates to gradually disengage from them, and to stop the related slide in both the carriage's directions of movement.

A first known form of producing the above-mentioned components is illustrated in FIGS. 1*a* and 1*b* in the enclosed drawings, in which two characteristic situations of the slides, respectively moving and stopped, are shown.

In these FIGS. 1 indicates a slide, one face of which features a groove, that couples in complementary fashion with the said bar, while a thread guide of known type, not illustrated, is locked to the opposite face of the slide 1, extending towards the needle beds below (not illustrated).

The upper edge 1*a* of the slide 1 forms a track P, whose profile is symmetrical in relation to the direction of movement of the carriage (not illustrated) of a knitting machine.

Anchor plates 50 work in conjunction with the above-mentioned carriage, these anchor plates taking up a raised or lowered vertical position (delimited using known means) which respectively cause the same anchor plate 50 to strike or not strike the track P of the slide 1 below it.

It should be emphasised that the above-mentioned known means delimiting the lowered position of the anchor plate 50 permit the latter a measure of "elastic excursion" in the direction of the raised position, enabling it to follow the profile of the aforementioned track P until reaching the related ledge 1*b*, formed in the same track P for each of the two directions of movement S, M of the carriage; the said slide 1 thus being drawn along together with the aforementioned carriage (FIG. 1*a*).

The distance moved by the slide 1 is limited, in each direction of movement S, M, by a stop 3, comprising a bracket 4 upon which a cam 5 is mounted.

In the example described, the stop 3 delimiting the end of stroke position in direction of movement S is considered.

The bracket 4 is removably mounted on the aforementioned bar 2 in the desired position in which the slide 1 stops when striking against the same bracket 4.

The cam 5, which operates beside the above-mentioned track P, is shaped in such a way as to enable the anchor plate 50 to gradually disengage from the aforementioned ledge 1*b* during the last stretch of the stroke of slide 1, by means of a first ramp 5*a* which lifts the anchor plate 50 itself, also enabling it to move over the above-mentioned bracket 4 (FIG. 1*b*).

The same cam 5 features a second ramp 5*b*, which enables the same anchor plate 50 to move over the bracket 4 during its stroke in the opposite direction immediately before engaging with the slide 1.

As can easily be deduced, it is possible for a slide 1 to be located in the section between two consecutive stops 3 in the known solution described above.

As a consequence the range of operating processes possible in the knitting machines incorporating the above-mentioned components is necessarily limited; in other words the above solution is acceptable for carriages fitted with only one operating unit.

A second known form of producing the above components is shown in the enclosed tables of drawings, in FIGS. 2*a*, 2*b*, 2*c*, which enables two slides to be fitted in each of the said sections between two consecutive stops; this is required on carriages featuring two identical operating units that are mounted beside one another. In order to effect this the components must not only comprise the slides described below, but also a further anchor plate, working in conjunction with each bar, in addition to those already present in the example above.

With reference to the said figures, 2 indicates a bar, identical to the previous one, to which a stop 3, similar to the one described above, is fixed.

The stop 3 delimits the end of stroke position on one side of two slides 10, 11, first and second respectively, for one direction of movement M of the carriage mounting two anchor plates 50*a*, 50*b*, with the said first anchor plate 50*a* operating with the aforesaid first slide 10, and with the second anchor plate 50*b* operating with the second slide 11.

The aforementioned slides 10 and 11 differ from one another, and from the above-mentioned slide 1, only where their upper ribs 10*a* and 11*a*, forming the same number of tracks P1 and P2, are concerned.

The upper ribs 10*a*, 11*a*, whose profiles are symmetrical to one another in relation to the direction of the movement of the aforesaid carriage, feature ledges 10*b* and 11*b* which serve the same function as ledges 1*b* described above.

The aforementioned tracks also feature two projections 10*c* and 11*c* which protrude from the related slides 10 and 11 and face one another.

The said projection 10*c* is aligned with the cam 5 of stop 3, while the projection 11*c* is aligned with the upper ribs 10*a*, 11*a*.

In this way it is possible for the said projections 10*c*, 11*c* to cross over, and for the above slides 10, 11 to move beside one another.

In FIG. 2*a* the first slide 10 is illustrated in its end of stroke position, which is to say stopped up against the stop 3, with the related anchor plate 50*a* disengaged from the corresponding ledge 10*b*.

In FIG. 2*b*, the second slide 11 is illustrated drawn along by the related anchor plate 50*b*, the latter being engaged with the corresponding ledge 11*b*, just before the aforementioned projections 10*c*, 11*c* cross over.

In FIG. 2*c*, the second slide 11 is illustrated at the end of its stroke behind the first slide 10, with the related anchor plate 50*b* disengaged from the ledge 11*b* as a result of the fact that the above-mentioned projections have crossed over. In the same way the same anchor plate 50*b* will be disengaged during a subsequent stage, not illustrated, by the first slide 10 as well as by the stop 3.

A first disadvantage of this second form of producing the components consists in the fact that it is impossible to increase the number of slides in each section between two consecutive stops beyond two, in contrast to more sophisticated machines whose carriages feature three or more independent operating units.

A second disadvantage results from the fact that the slides 10, 11, as well as the stops 3, differ from one another, thus leading to both higher production costs and higher warehouse costs.

SUMMARY OF THE INVENTION

The object of the present invention is to propose a universal thread guide support device that is able to fulfil its related function in both directions of movement of the carriage, and to be fitted in any number whatsoever in the sections between two stop brackets immovably mounted on the same bar.

The above objects are obtained proceeding in accordance with that proposed in claim 1.

BRIEF DESCRIPTION OF THE DRAWINGS

The characteristics of the present invention are emphasised hereinafter with specific reference to the enclosed drawings, in which.

DESCRIPTION OF THE PREFERRED EMBODIMENT

Figure 1A:
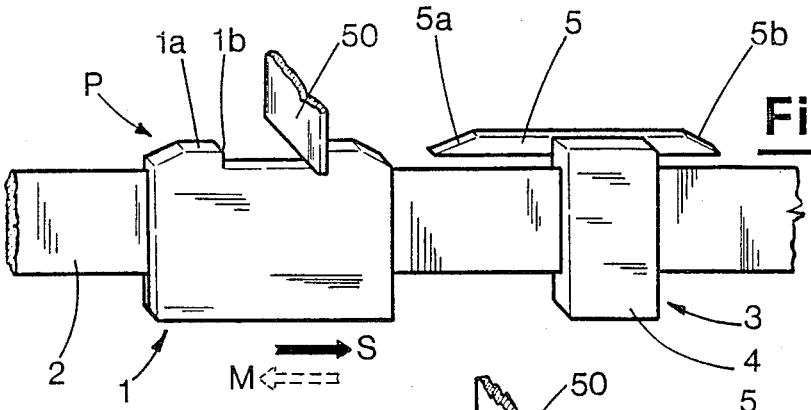
FIGS. 1*a* and 1*b* illustrate a first known form of producing the above-mentioned components with the slides in two characteristic situations, respectively moving and stopped.
Figure 1B:
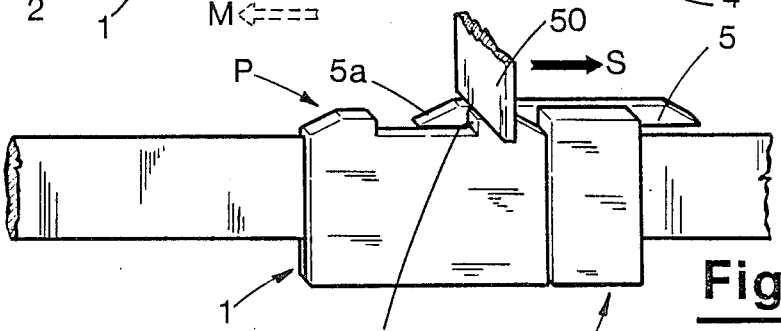
Figure 2A:
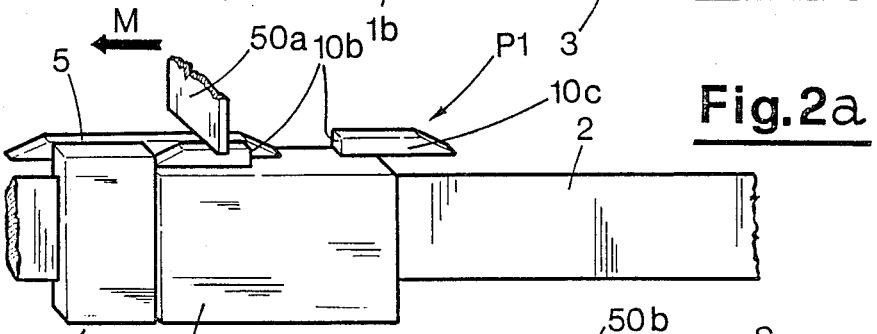
FIG. 2*a* illustrates the disengagement of the first anchor plate 50*a* from the corresponding first slide 10 at the end of the latter's stroke.
Figure 2B:
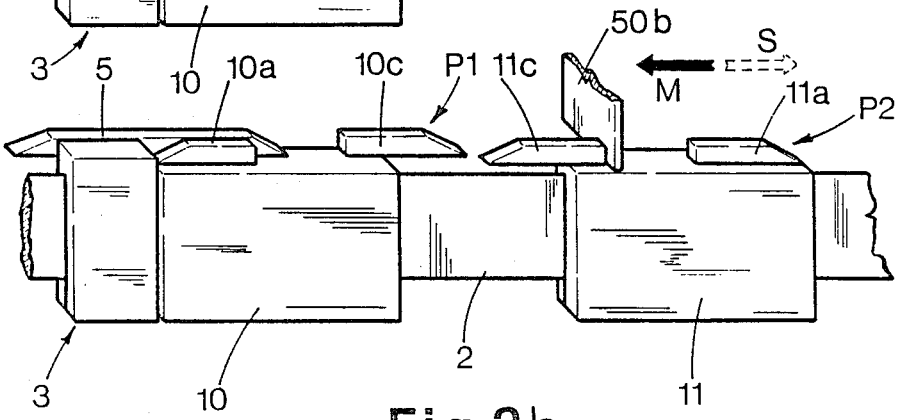
FIG. 2*b* illustrates the second slide 11, drawn along by the second anchor plate 50*b*, before it is stopped.
Figure 2C:
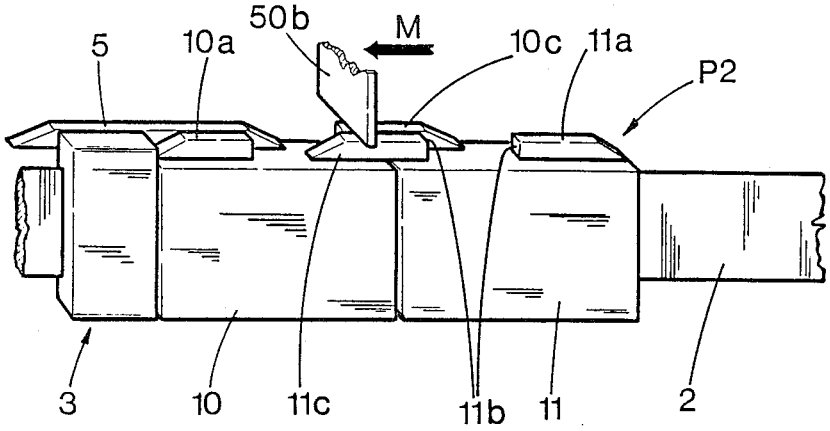
FIG. 2*c* illustrates the disengagement of the of the second anchor plate from the second slide at the end of the latter's movement behind the first slide.

With reference to the said figures, 2 indicates a bar, located above the needle beds 70 of a knitting machine, upon which a slide 100, the object of the present invention, is mounted in such a way that it couples with and is able to slide along the bar 2.

This is made possible by the fact that one face of the body 101 of the slide 100 features a horizontal groove that couples in complementary fashion with the bar 2, in a similar way to the slides of known type described above. The opposite face of the body 101 features a vertical groove which is designed to receive the upper portion 60*a* of a thread guide 60, of known type, that extends towards the needle beds 70 below.

The upper rib 101*a* of the slide 100 forms a track P3, whose profile is symmetrical in relation to the direction of movement of the carriage 90 (directions S, M) of a knitting machine.

The above-mentioned track P3 features two ledges 101*b*, each of which serve for one direction of movement of the carriage 90; the latter features anchor plates 50 which, when in their lowered position, strike against the aforesaid ledges 101*b* in order to draw along the slide 100; the stroke through which this latter moves being delimited, in each of the aforementioned directions of movement, by a stop 3 comprising a bracket 4 which is removably mounted on the bar 2.

Two rockers 40, each of which operates in conjunction with one of the above-mentioned ledges 101*b*, are mounted in a symmetrical position so that they pivot near the upper rib 101*a* on the aforesaid body 101.

Each rocker 40 comprises two arms 41, 42, first and second respectively, the first arm 41 of which extends beside the above-mentioned track P3, beyond the corresponding ledge 101*a* towards the centre of the aforementioned body 101, and the second arm 42 of which extends downwards by the side 101*c* of the same body 101.

The end of the first arm 41 is tapered, forming a first ramp 41*a* for rising above the aforementioned ledge 101*b*.

A boot 43 in shock-absorbing elastic material is fitted to the free end of the second arm 42.

The rocker 40 features a second ramp 44 between the above-mentioned arms 41, 42, designed to be gradually borne upon by the aforementioned anchor plate, acting on the above-mentioned track P3.

Figure 3:
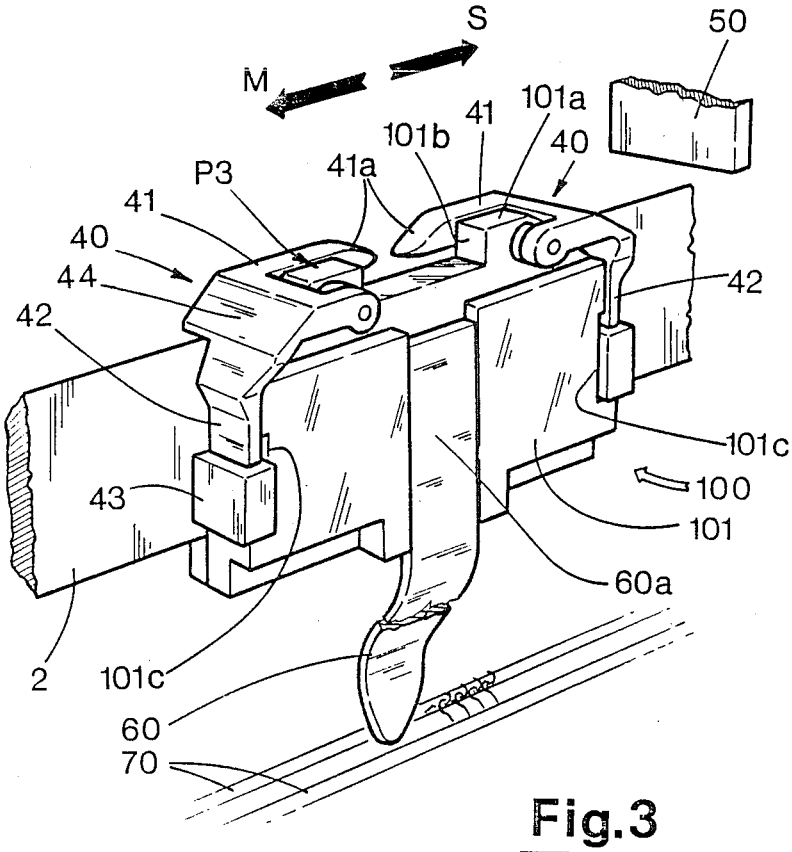
FIG. 3 is an illustration in perspective of the slide which is the subject of the present invention.

The second ramp 44 slants in the opposite direction to the aforementioned first ramp 41*a* (FIG. 3).

Each rocker 40 is able to turn through a predetermined angle around the axis of the above-mentioned pivot from a first position T to a second position R, and vice versa.

In the said first position T, the first arm 41 is aligned with the aforesaid track P3, and the second arm 42 is situated alongside side 101*c* of the body 101.

In the aforementioned second position R, the first arm 41 is lowered whilst the second arm 42 is moved away from the aforesaid side 101*c*.

The above-mentioned rotation can alternatively be free, prevented or actively effected following the modes described below.

Figure 4A:
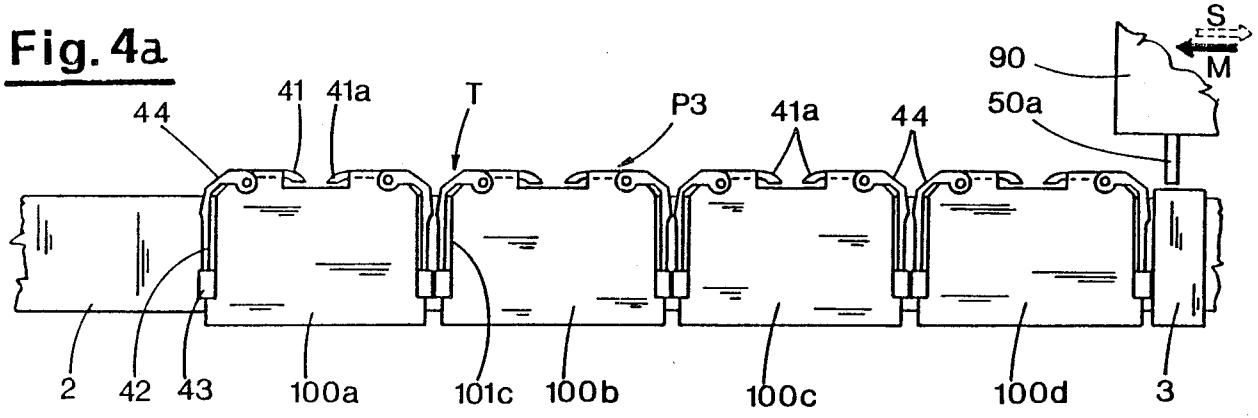
FIGS. 4*a*, 4*b*, 4*c*, 4*d*, 4*e*, 4*f* are diagrammatic side views of the most important operating stages of a series of slides mounted so that it couples with a bar.

FIG. 4*a* illustrates, by way of example, four slides 100*a*, 100*b*, 100*c*, 100*d*, first, second, third and fourth respectively, that are situated up against one another, with the said fourth slide 100*d* in its turn being stopped up against one of the above-mentioned stops 3 present on the bar 2.

FIG. 4*a* also illustrates a first anchor plate 50*a*, in the lowered position, moving in direction M, close to the aforesaid stop 3.

Figure 4B:
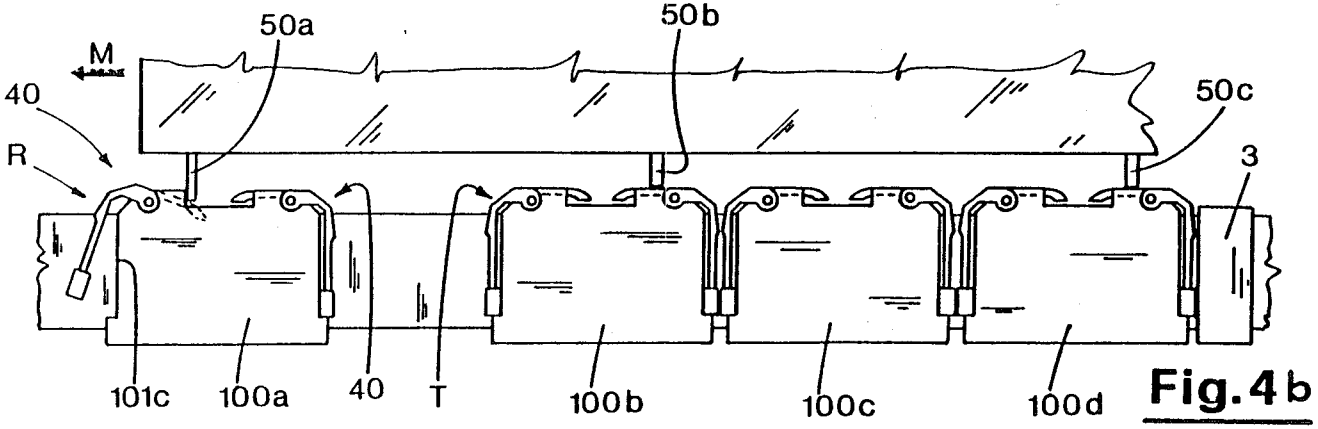

FIG. 4*b* shows the above-mentioned first anchor plate 50*a*, which, having moved beyond the aforementioned fourth, third and second slides, has reached the first slide 100*a*, and, positioned on the related ledge 101*b* of the track P3 of the same slide 100*a*, draws the latter along in direction M.

During the stage described above, the aforementioned anchor plate 50*a* is able to follow the profiles of each track P3, without striking against any of the ledges 101*b* of the aforementioned fourth, third and second slides, in that the rockers 40 of each of the latter, being in contact with one another, or in contact with the stop 3, are prevented from rotating and held in position T.

The presence of the first ramps 41*a* and second ramps 44, and the fact that the movement of the aforementioned anchor plate 50*a* permits it a certain amount of vertical "elastic excursion", as stated above, cause the first slide 100*a* to be struck and drawn along as described above, the rocker 40 of the latter, for ledge 101*b* regarding operation when the carriage 90 is moving in direction M, being able to freely rotate from the first position T to the second position R as a result of the pressure exerted by the same anchor plate 50*a* upon the first arm 41, which, moving downwards, enables the anchor plate 50*a* itself to strike the above-mentioned ledge 101*b*.

Other anchor plates 50*b*, 50*c*, second and third respectively, are shown in the same FIG. 4*b*, designed to draw along the corresponding second and third slides 100*b*, 100*c* as shown in the following FIG. 4*c*.

Figures 4C, 4D, 4E, 4F:
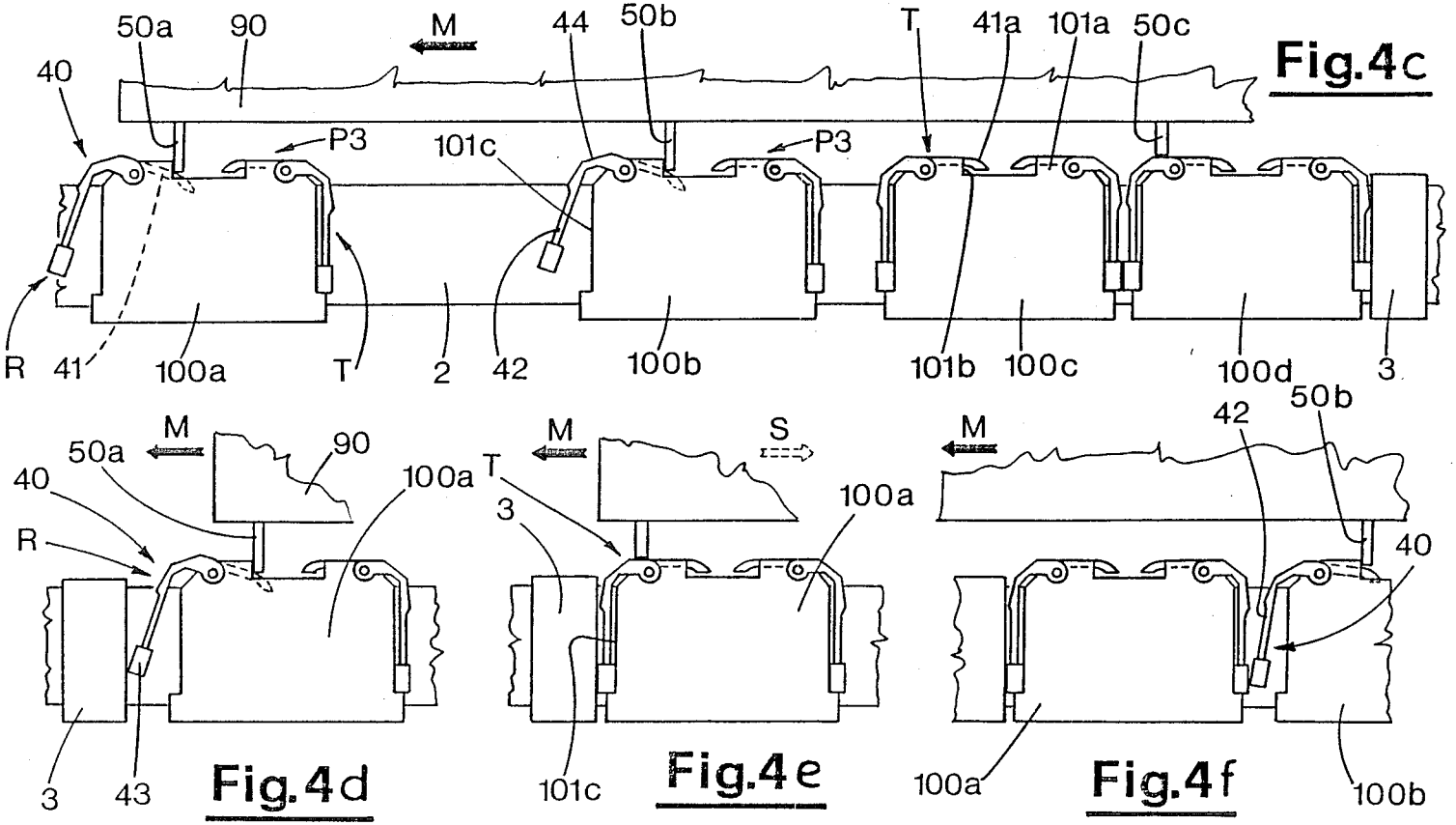

FIG. 4*d* shows the same first slide 100*a* drawn along by the corresponding first anchor plate 50*a*, in the last section of its stroke towards the stop 3, with the latter being struck by the boot 43 fixed to the second arm 42 of the above-mentioned rocker 40 in position R.

As a consequence of the aforesaid second arm 42 striking the stop 3, the same rocker 40 is made to rotate from the aforementioned second position R to the first position T.

As a consequence of this, the first arm 41 lifts and disengages the above-mentioned anchor plate 50*a* from the related ledge 101*b* (FIG. 4*e*).

The following FIG. 4*f* shows an intermediate stage where the second anchor plate 50*b* is disengaged from the corresponding slide 100*b*, close to the latter's stopping up against the above-mentioned first slide 100*a* in the same way as described above.

The above sequence of stages is effected once again, if programmed, during the carriage's stroke in direction S, opposite to direction M, with the related anchor plates striking the slides in the reverse order, from the fourth slide 100*d* onwards.

The technical advantages conferred by the technical solution described above are clear, in particular regarding the possibility of fitting a large number of slides in the section between two stops, consequently optimising one's use of the carriage's corresponding operating units.

The above-mentioned slides are perfectly identical, which simplifies both their production and use; this enables stops of the same kind to be used, it being sufficient for these to be simple brackets.

In addition to this, the special design of the slides, and their related rockers, ensures the optimum operation of all the components described, particularly due to the lack of any jamming, possible in known types of slides using fixed elements.

It is understood that the description supplied herein is solely an unlimited example, such that possible variations to the construction details will not affect the protective framework afforded to the invention as described above and claimed hereinafter.

What is claimed is:

1. Improved device for supporting the thread guide of an automatic flat knitting machine, said machine comprising at least one bar, located parallel to and above needle beds of said machine, a carriage, able to move in a horizontal plane, and fitted with anchor plates, being able to move in a vertical plane, said anchor plates being able to strike against slides and draw along said slides in directions of movement of said carriage with said slides mounted so that they couple with said bar and can be drawn along a section of the said bar delimited by two consecutive stops fixed to the same bar, each of said slides comprising a body featuring: a horizontal groove in one face of said body and coupling in complementary fashion with said bar; a vertical groove on the opposite face of said body, designed to receive an upper portion of a thread guide, said thread guide extending towards said needle beds; a track formed by an upper rib of said body, said track featuring a ledge for each direction of movement of said carriage, said ledges being designed to be struck by said anchor plate, in a lowered position, for said slide to be drawn along, with said slide comprising: two rockers, mounted so that they pivot on said body, in a symmetrical position in relation to a plane perpendicular to said bar, each of said rockers working in conjunction with one of said ledges and comprising two arms, first and second respectively, with said first arm extending beside said track, beyond a corresponding ledge towards the centre of said body, and with said second arm extending downwards by a side of said body, with said rocker able to rotate through a predetermined angle around the axis of said pivot, from a first position in which said first arm is aligned with said track, and said second arm is situated alongside said side to a second position in which said first arm is lowered and said second arm is moved away from said side, and viceversa; it being possible for said rotation to be alternatively free, actively effected or prevented, said rotation being free, from said first position to said second position, and effected in synchrony with the striking of said anchor plate first against said first arm and then against said ledge, said rotation being actively effected, from said second position to said first position, as a result of said second arm striking against one of said stops or against said second arm of a further identical slide, said rotation finally being prevented in said first position as a result of said slide itself being in a stopped position with its said second arm stopped up against one of said stops or against said second arm of another slide.

2. Device as in claim 1, wherein said rocker features two ramps, first and second respectively, said first ramp being formed in the end of said first arm for enabling movement over said ledge; and said second ramp being formed between said first and second arms, and sloping in an opposite direction to said first ramp, in order to lead smoothly on to said track.

3. Device as in claim 1, wherein the end of said second arm features a boot in a shock-absorbing elastic material.

* * * * *